United States Patent [19]

Hauville

[11] Patent Number: 4,838,175

[45] Date of Patent: Jun. 13, 1989

[54] LABORATORY TABLE

[76] Inventor: François P. Hauville, 264, rue de la Villette, Saint-Pierre les Elbeuf, 76320 Caudebec les Elbeuf, France

[21] Appl. No.: 218,483

[22] Filed: Jul. 7, 1988

Related U.S. Application Data

[63] Continuation of Ser. No. 000,899, Jan. 6, 1987.

[30] Foreign Application Priority Data

Jan. 23, 1986 [FR] France ..... 86 00951

[51] Int. Cl.[4] ..... A47C 35/00

[52] U.S. Cl. ..... 108/25; 108/50; 312/223

[58] Field of Search ..... 108/50

[56] References Cited

U.S. PATENT DOCUMENTS

| | | | |
|---|---|---|---|
| 3,883,202 | 5/1975 | Konig | 312/223 |
| 4,040,692 | 8/1977 | Sass et al. | 312/194 |
| 4,160,323 | 7/1979 | Tracy | 312/209 |
| 4,372,629 | 2/1983 | Propst et al. | 312/223 |
| 4,437,411 | 3/1984 | Maxwell | 312/209 X |
| 4,535,703 | 8/1985 | Henriott et al. | 312/223 |
| 4,645,878 | 2/1987 | Hilger et al. | 312/223 |
| 4,654,756 | 3/1987 | Wilson | 312/223 X |

FOREIGN PATENT DOCUMENTS

| | | | |
|---|---|---|---|
| 780206 | 7/1957 | United Kingdom | 108/25 |

*Primary Examiner*—Peter A. Aschenbrenner
*Attorney, Agent, or Firm*—Sherman and Shalloway

[57] ABSTRACT

A table, notably a laboratory table, characterized in that it is provided, in its frontal face, with a collector-distributor made of a channel arranged in such a manner as to support the utilities such as the electric plugs, water fittings and fluid feeding pipes, disposal basins for equipping the table, as well as to receive and lead the cables and pipes likely to connect the apparatuses used on the table and their accessories to each others.

8 Claims, 2 Drawing Sheets

LABORATORY TABLE

This application is a continuation of application Ser. No. 000,899 filed Jan. 6, 1987.

FIELD OF THE INVENTION

The present invention relates to an improved table, notably a laboratory table.

The essential condition which such a table should satisfy, notably a laboratory table, is to offer a working plane the surface of which is as clear as possible of protrusions and obstacles which can result from the presence of members and means such as electric plugs, fittings, basins and others, necessary for bringing to the working plane the various utilities such as electric energy, fluids of all sorts, or for discharging the residues of the works effected on the table.

This condition is hardly satisfied with known tables in which the utilities just mentioned, always placed at the rear of the table plate, occupy it to the prejudice of the apparatuses it receives on its working plane, said apparatuses being in turn prejudicial to the accessibly, with a view to their use or setting, of the utilities in question.

BACKGROUND OF THE INVENTION

It is of course known, for remedying in part these disadvantages, to place certain means or members such as electric plugs on the front vertical portion of the table, but the feeding wires of the apparatuses hang therefore on the table front face before extending to the rear of the apparatuses where they are usually connected. The disadvantage of the front positioning of the electric plugs is that the wires in front of the table can be caught by accident, thereby causing the possible fall of the apparatuses or their accessories. A disadvantage of such a positioning is also that the wires necessary for the connexions of the apparatuses are on the working plane, therefore occupy a space on said working plane and make its use and cleaning difficult.

On the other hand, the fact of placing water or gas taps, power electric plugs and basins buried in a working plane, renders the latter irremovable and does not allow to lift it for providing an easy access to the main feeding pipes for maintenance or repair purposes as well as for establishing complementary connexions.

Under such conditions, the transformation for adapting the table to uses other than those considered at the origin is extremely difficult, such as for example the creation of a water station made of a buried basin and its discharge, or for mounting extra fittings.

Finally, the main defect of the tables of traditional design results from the positioning of the utilities on the rear portion of the table, thereby making their use difficult when, as in the majority of cases, the apparatuses before them hide them to such a point that they become inaccessible. In some cases concerning wide and high apparatuses or assemblies, it is practically impossible to have an access to the utilities, which is at times a factor of accident of which the user is the victim, when it is necessary to quickly intervene for stopping water fittings or disconnecting an electrical supply.

OBJECT AND SUMMARY OF THE INVENTION

The present invention eliminates all these disadvantages.

It consists essentially in having the table comprising on its frontal face a collector-distributor made of a technical channel arranged in such manner as to receive all the utilities such as the plugs, gas and water fittings, water discharge basins, provided for fitting out the table, and also arranged according to the invention for receiving and leading the cables and pipes connecting the apparatuses and their accessories to each others.

BRIEF DESCRIPTION OF THE DRAWINGS

An embodiment of the invention will now be described hereafter by way of a non limiting example, with reference to the accompanying drawings in which.

DETAILED DESCRIPTION OF THE INVENTION

Figure 1:
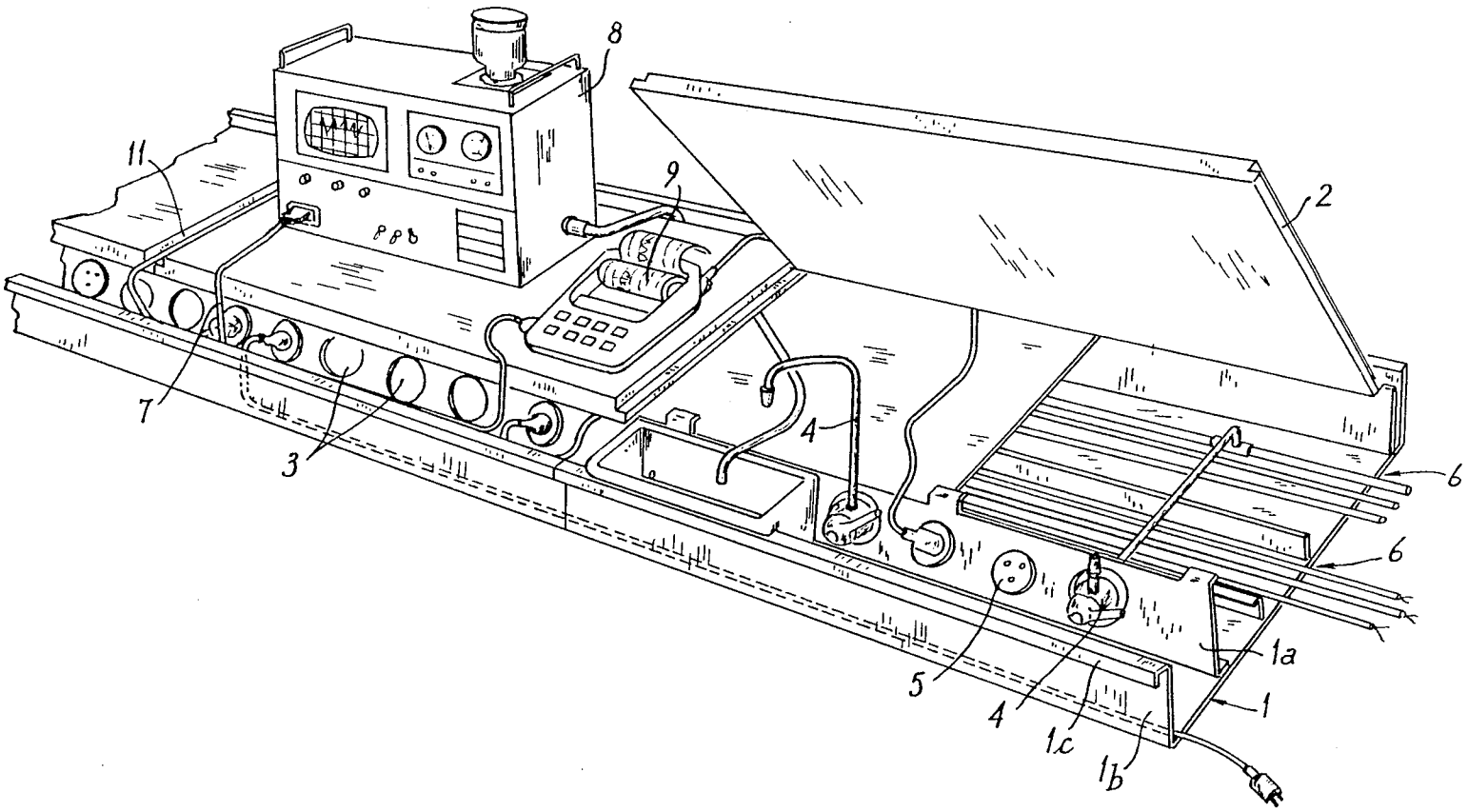
FIG. 1 is a perspective view.
Figure 2:
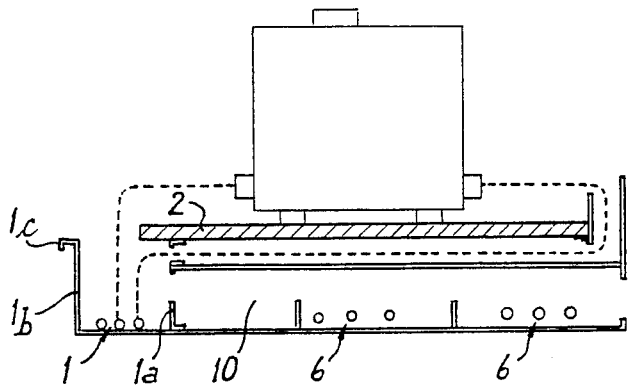
FIG. 2 is a transverse partial sectional view of a laboratory table according to the invention.

As is shown notably in FIG. 1, the table includes according to the invention a channel 1 forming a collector-distributor. In this example, the channel is U-shaped with a flat bottom. The rear vertical wall 1*a* against which is applied the working plane 2, is formed with perforations 3 for receiving, on platens fitted inside said perforations, water fittings 4, electric plugs 5 and various accessories connected to energy distribution layers 6 placed for example underneath working plane 2.

The horizontal portion of said channel is used for leading and supporting the cables and pipes, such as 7, which connect the apparatuses such as 8 and their accessories such as 9 to each others.

The vertical frontal portion 1*b* of the channel protects the cables and operating members of the fluid fittings, such as gas and water fittings, from being accidentally caught by the user during his displacements or movements in the laboratory.

Channel 1 which is used as a collector-distributor is advantageously in communication with a technical void 10 provided underneath the working plane, void in which the cables and pipes extending from the rear of the apparatuses placed on the table finally arrive prior to be connected to the utilities placed in the channel or to be led by said channel to another place of the table where is positioned for example another apparatus necessitating the establishment of a connection with the first apparatus.

As regards working plane 2, which can be monolithic or made of several juxtaposed elements, the dispositions adopted according to the invention allow mounting it in a removable manner and advantageously in a pivoting manner, as shown in FIG. 1. When made of several elements, as for the example treated, it is possible to provide at the junction of the elements slots or rabbets 11 inside which can extend the cables and other pipes extending from the rear of the apparatuses and ending into collector 1.

Figure 3:
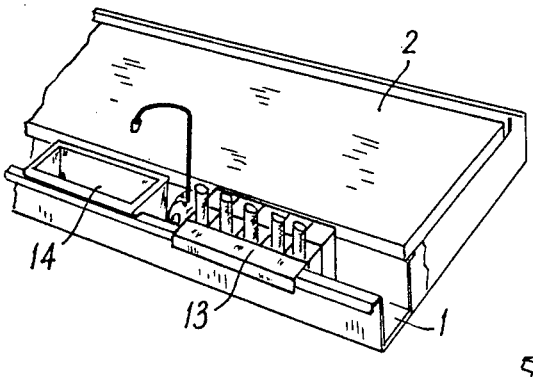
FIGS. 3 to 5 are perspective partial views showing the adaptation of the table to some accessories.
Figure 4:
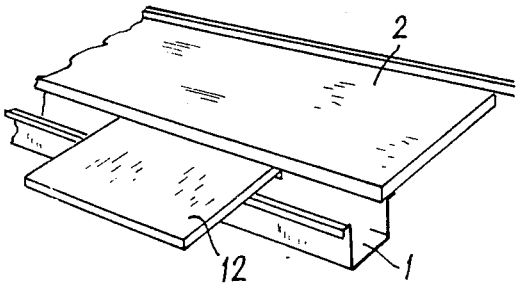
Figure 5:
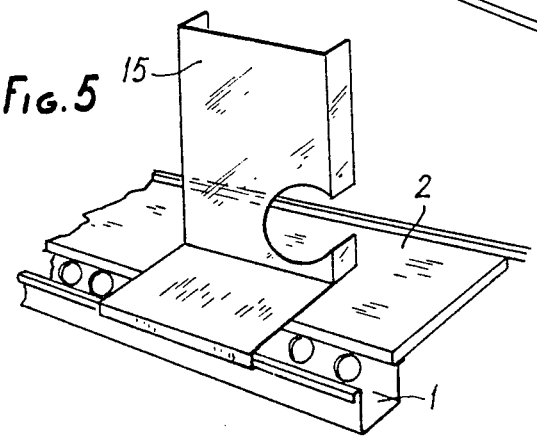

Due to the dispositions according to the invention which are adopted, it is easy, as shown in FIGS. 3 to 5, to adapt to the table, at any point of said table, the most different accessories, such as writing boards 12 (FIG. 4), test tube-holders 13 and mini-basins 14 (FIG. 3), protections screen 15 (FIG. 5) bearing either on the working plane or in the bottom of the collector channel, and in any case on a turned over edge 1*c* of channel 1.

From the foregoing, one sees that the invention offers important and many advantages.

First of all, it allows generally to totally clear the working plane of all connecting cables or pipes, thereby offering a free and instantaneous access to the utilities which have to be connected to the apparatuses placed on the table, to the water fittings, electrical plugs and discharge basins, the working plane surface being moreover totally free from such means and members.

On the other hand, the invention is particularly adaptable to the disposition of the main pipes in horizontal layers situated underneath the removable and pivotable working plane, whereby their mounting by a user working in a standing position is made easy.

The invention provides also an easy access, by lifting the working plane, to the main pipes for maintenance, extra connexions and other purposes.

The invention makes possible a standard and industrialized manufacture of working planes free of holes for water fittings or discharge basins, hence the possibility of an industrial manufacture of standard modules of prefabricated tables receiving their equipment to order, thereby meeting the requirement of installation, adaptation and reconversion flexibility demanded by modern laboratories, particularly as regards placement, displacement of the table modules and the creation of utilities of any nature, such as water fittings, discharge basins, plugs, etc.

Finally, the invention is particularly adaptable to the organization by the user of his working station with respect to the transport of cables and pipes connecting the apparatuses to each others and to the satisfaction of safety requirements concerning a usual access and emergency interventions to the stop valves and the disconnecting members of electrical supplies.

What is claimed is:

1. A laboratory table comprising:

a substantially rectangular, longitudinally extending, horizontal working plane, said working plane having a front longitudinal edge, a rear longitudinal edge, a top work surface and a bottom surface;

a substantially U-shaped channel comprising a substantially vertical, longitudinally extending rear member having a top edge and a bottom portion, a substantially vertical, longitudinally extending front member having a top edge and a bottom portion, and a substantially horizontal, longitudinally extending bottom member conjoining said bottom portions of said front member and said rear member;

said U-shaped channel extending longitudinally substantially parallel to said front longitudinal edge of said working plane, said top edge of said rear member engaging said bottom surface of said working plane, said top edge of said front member disposed forwardly of and spaced apart from said front longitudinal edge of said working plane;

a plurality of apertures formed in said rear member of said U-shaped channel, each of said apertures receivable of a utility supply fitting;

whereby said U-shaped channel may contain at least a portion of a connection member connecting a utility supply fitting to an apparatus disposed on said top work surface and said front member protects and utility supply fitting from inadvertent contact with a human operator.

2. The table according to claim 1, wherein said working plane is mounted in a removable manner.

3. The table according to claim 2, wherein said working plane is mounted so as to be pivotable about an element forming a table support framework.

4. The table according to claim 1, wherein a void is provided beneath said working plane so as to contain therein utility supply means for providing utilities to said utility supply fittings.

5. The table according to claim 1, wherein said working plane is made of several juxtaposed elements, a junction between adjacent said elements forming a groove serving as a passage for a utility connection element which has to be brought to said U-shaped channel for clearing said work surface.

6. The table according to claim 1, further comprising at least one additional aperture formed in said rear member of said U-shaped channel, said at least one additional aperture receivable of at least one utility connecting element therethrough, said utility connecting element connecting a back side of an apparatus disposed on said top work surface with a utility supply fitting disposed in one of said plurality of apertures, said utility connecting element passing beneath said working plane.

7. The table according to claim 1, wherein at least one of said plurality of apertures contains an electrical socket.

8. The table according to claim 1, wherein at least one of said plurality of apertures contains a water fitting.

* * * * *